US005770815A

United States Patent [19]

Watson, Jr.

[11] Patent Number: 5,770,815

[45] Date of Patent: Jun. 23, 1998

[54] AMMUNITION CARTRIDGE WITH REDUCED PROPELLANT CHARGE

[75] Inventor: Fred W. Watson, Jr., Montross, Va.

[73] Assignee: The United States of America as represented by the Secretary of the Navy, Washington, D.C.

[21] Appl. No.: 514,888

[22] Filed: Aug. 14, 1995

[51] Int. Cl.[6] ..... F42B 8/12

[52] U.S. Cl. ..... 102/447; 102/439; 102/513

[58] Field of Search ..... 102/430–433, 102/439, 444–447, 464, 466, 467, 498, 502, 513, 529, 700

[56] References Cited

U.S. PATENT DOCUMENTS

| | | | |
|---|---|---|---|
| 220,030 | 9/1879 | McGowan | 102/447 |
| 463,528 | 11/1891 | Mieg | 102/447 |
| 780,003 | 1/1905 | King | 102/447 |
| 2,541,025 | 2/1951 | Bluford et al. | 89/29 |
| 2,826,145 | 3/1958 | Sandberg et al. | 102/41 |
| 2,902,933 | 9/1959 | Moldofsky et al. | 102/41 |
| 3,749,023 | 7/1973 | Kawaguchi et al. | 102/431 |
| 4,157,684 | 6/1979 | Clausser | 102/38 R |
| 4,208,968 | 6/1980 | Huboch et al. | 102/513 |
| 4,301,732 | 11/1981 | Van Sickle | 102/513 |
| 4,430,940 | 2/1984 | Jermunson | 102/446 |
| 4,444,115 | 4/1984 | Romer et al. | 102/431 |
| 4,455,942 | 6/1984 | Murray et al. | 102/444 |
| 4,955,300 | 9/1990 | Bertiller et al. | 102/446 |
| 4,958,567 | 9/1990 | Olson | 102/444 |
| 5,277,118 | 1/1994 | Conil | 102/431 |

FOREIGN PATENT DOCUMENTS

| | | | |
|---|---|---|---|
| 10619 | 8/1909 | France | 102/447 |
| 3649 | of 1884 | United Kingdom | 102/447 |
| 10755 | of 1888 | United Kingdom | 102/496 |

*Primary Examiner*—Harold J. Tudor
*Attorney, Agent, or Firm*—James B. Bechtel, Esq.

[57] ABSTRACT

An ammunition cartridge having a reduced propellant charge and an initial reduced cartridge volume is provided. The cartridge volume is reduced by partially filling the cartridge case with a foam filler using a male mold form. The male mold form is sized to provide the desired propellant volume and tapered to maintain the desired cartridge pressure during the propellant burn. Alternately, the foam filler may be formed externally and inserted into the cartridge case. In that embodiment, an adhesive retainer is used to secure the foam filler to the base of the case. During firing, the foam filler is turned into a gas, thereby providing the large volume of the case for expansion of the propellant gases. After firing, the case is free of residue, all of the foam filler having been expelled as a gas.

5 Claims, 3 Drawing Sheets

AMMUNITION CARTRIDGE WITH REDUCED PROPELLANT CHARGE

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

This invention relates to the field of cartridge manufacture and more specifically to the manufacture of practice rounds or spotting rounds having reduced powder charges.

BACKGROUND OF THE INVENTION

The use of practice shells and spotting charges having relatively large volumes, but reduced powder charges, has resulted in problems of inconsistent charge ignition for many types of case gun ammunition. Small charges in cases with large volumes typically have problems with inconsistent ignition by the primer charge. This inconsistency is due to the charge being inconsistently positioned inside the case relative to the primer. The result frequently is a large variation in the pressure and velocity from detonation to detonation. Numerous attempts have been made to solve this problem. Typical solutions are the shaping of charges and the inserting of manufactured reducers inside the ammunition case. Each of these solutions is costly and time consuming. A typical example of this technology can be seen in the spotting cartridge used in the Shoulder Launched Multipurpose Assault Weapon (SMAW) spotting cartridge. The spotting cartridge in this weapon requires a low velocity 9 mm round with the use of a large rifle case. The present round uses a main case made from a necked-up 7.62 mm NATO case machined to accept a 0.22 caliber Hornet™ case. The small 0.22 caliber Hornet™ case is used to retain powder in the base. This type of design is very expensive and time consuming to manufacture. A simple method of positioning the powder within a larger case and containing the initial powder position and form during the ignition of the explosive is required. Among the current methods used to reduce case volume is the machining of the case to produce a reduced volume. This method is also very costly. Another method is to place cotton or some type of packing to retain the charge near the primer in the case. This type of solution is subject to problems due to vibration or movement which can dislodge the packing and in turn allow the powder to move away from the primer. Each of these problems gives inconsistent velocity and leaves burning residue inside the chamber. What is needed is a means to: locate the powder inside the case; secure it so it cannot be dislodged or moved during handling; and, maintain it in the proper position and shape during firing of the cartridge. Additionally, no residue or other blockage of the original case volume should occur.

SUMMARY OF THE INVENTION

Accordingly, it is an object of the invention to provide an ammunition cartridge having a reduced volume for containing the propellant.

It is another object of the invention to provide an ammunition cartridge having a means of securing the reduced propellant charge during handling and during ignition of the premium charge.

It is yet another object of the invention to provide an ammunition cartridge having a means of providing a large expansion chamber within the cartridge for gas expansion.

The invention is an ammunition cartridge having a reduced propellant charge and an initial reduced cartridge volume. The cartridge volume is reduced by partially filling the cartridge case with a foam filler using a male mold form. The male mold form is sized to provide the desired propellant volume and tapered to maintain the desired cartridge pressure during the propellant burn. Alternately, the foam filler may be formed externally and inserted into the cartridge case. In that embodiment, an adhesive retainer is used to secure the foam filler to the base of the case. During firing, the foam filler is turned into a gas thereby providing the large volume of the case for expansion of the propellant gases. After firing the case is free of residue, all of the foam filler having been expelled as a gas. In either filler method, the foam filler is formed in a hollow cylindrical shape having an open interior volume.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
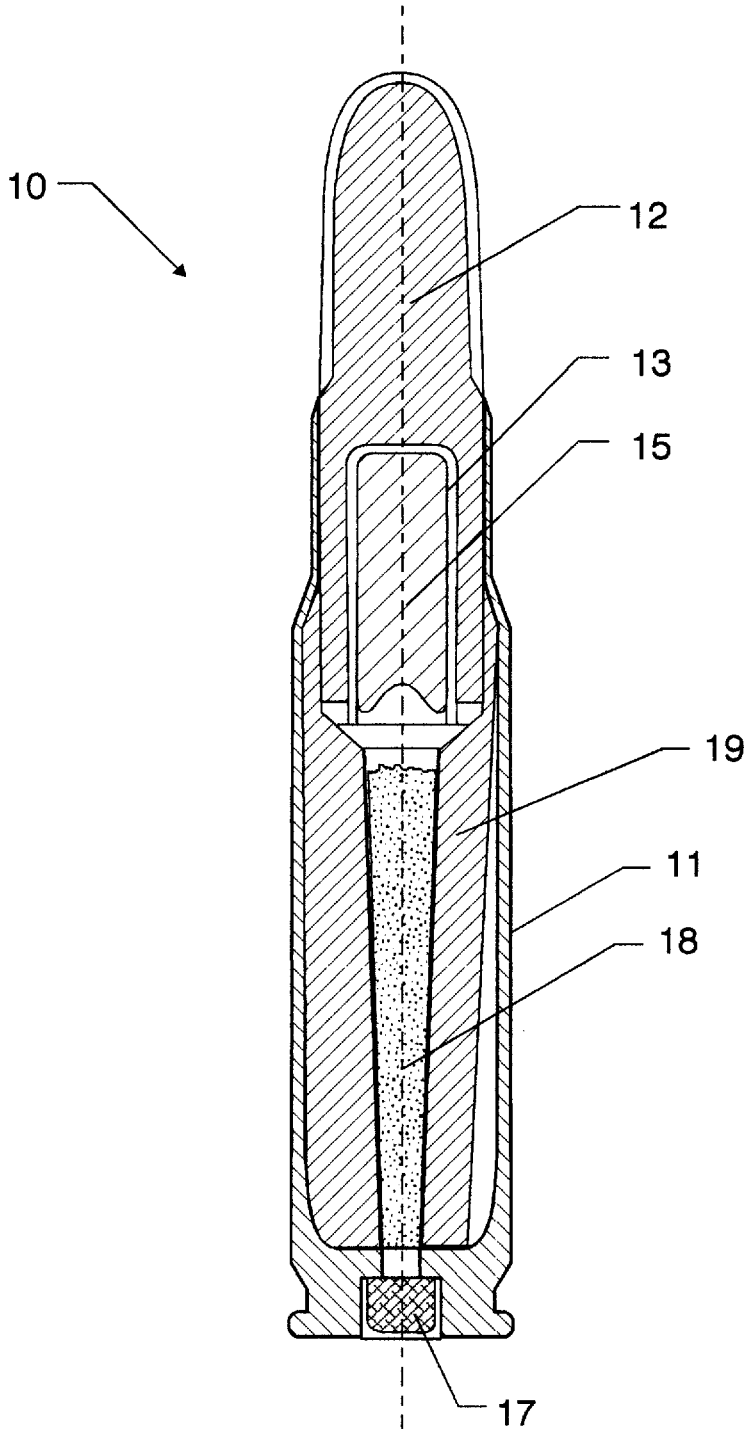
FIG. 1 is a sectional side view of the SMAW Spotting Cartridge Case showing the lost foam case volume reducer.

Referring now to FIG. 1, the ammunition cartridge with reduced propellant charge, designated generally by the reference numeral 10, is shown with its major elements. In this embodiment, a typical spotter round is depicted. The cartridge case 11 holds a projectile 12 in the open end of the case. The projectile 12 contains a tracer case 13 in which tracer material 15 is loaded. A case primer 17 is located in the base of the cartridge case 11. The propellant material or powder 18 is held in a tapered conical interior volume formed by the foam filler 19. Typically, different sizes and shapes of foam filler can be used, the common feature being that each will form a hallow cylindrical insert having an open interior volume. The precise size and shape of the interior volume will be determined by the type of propellant and particular ballistics that are required.

When the cartridge is fired, the foam filler 19 is turned into a gas and is expelled from the case. In this process, the foam filler provides functions. First, the powder or propellant material 18 is held securely in place with respect to the primer 17. Second, the integrity and shape of the propellant material is maintained during any handling or rough shipment and during the firing of the propellant charge. Third, the volume used by the filler becomes immediately available for expansion space during firing as the foam is gasified. Fourth, the fired cartridge has no remaining residue allowing easy reloading of the cartridge.

Figure 2:
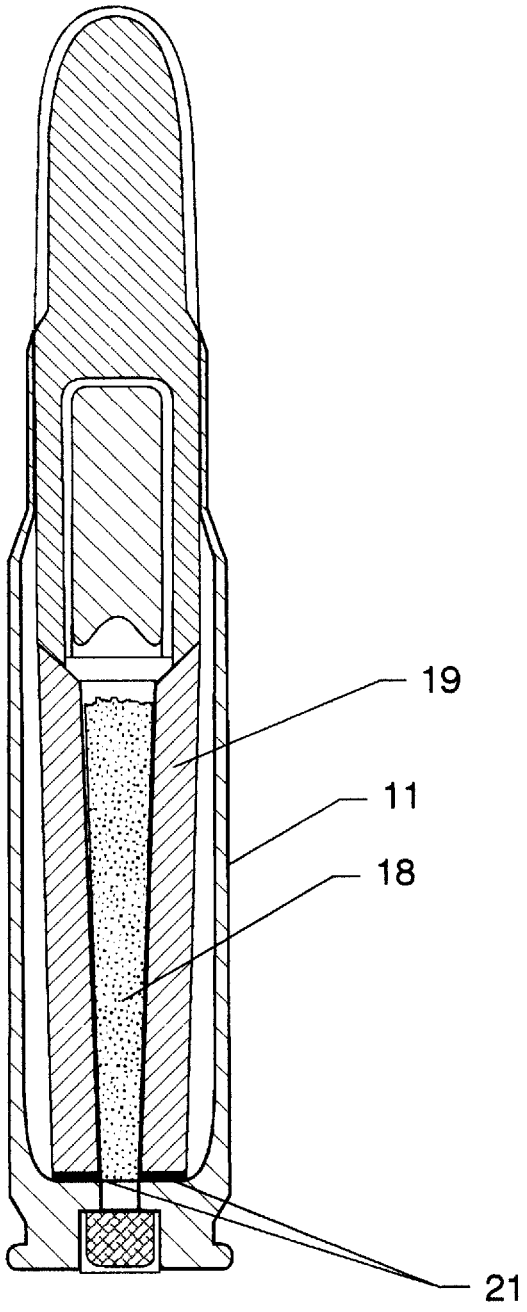
FIG. 2 is a sectional side view of the SMAW Spotting Cartridge Case showing an externally-formed adhesive retainer for the lost foam.

Referring now to FIG. 2, the ammunition cartridge with reduced propellant charge is shown with the externally-formed foam filler 18 in place within the cartridge case 11. In this embodiment, it is to be noted that the foam filler 19 has an external taper and a sufficiently small outside diameter so that it may be inserted into the cartridge case 11 from the necked-down open end of the case. As with the mold-in-place embodiment, the foam filler forms a hollow cylindrical shape having an open interior volume. Additional modifications include the addition of an adhesive retainer 21 at the base of the foam filler used to secure the foam filler to the base of the case.

Figure 3:
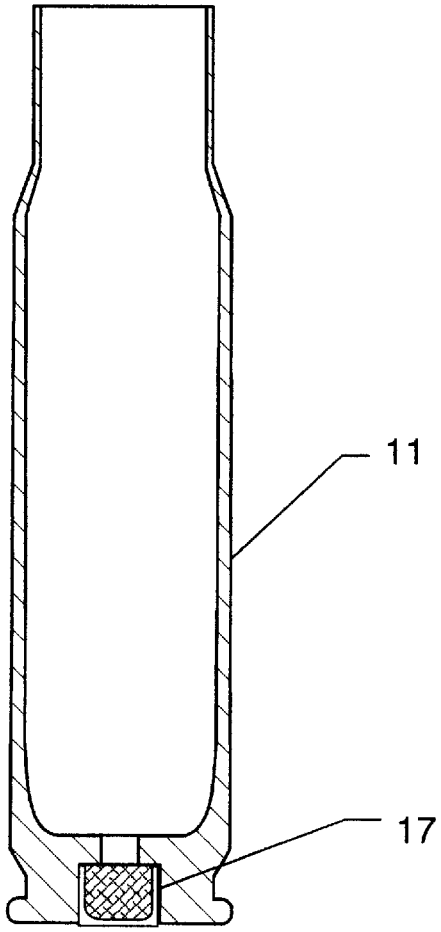
FIG. 3 is a sectional side view of the SMAW Spotting Cartridge Case showing a fired case with the lost foam expelled.

FIG. 3 depicts the cartridge after firings. The foam filler is completely gasified and expelled from the case 11 during firing. The case 11 is now reusable by replacement of primer 17 and reloading of the cartridge.

The novel features and benefits of the invention are numerous. No machining is required to prepare the case for the reduced propellant charge. There is no loss of expansion volume during firing as the foam is vaporized during firing. The propellant charge may be easily sized and shaped by modifying the foam filler. Manufacture of the cartridge is a simple matter of inserting a mold form in the end of the cartridge and injecting the foam filler. Alternately, foam inserts can be molded externally and glued in place using an adhesive retainer. No special cartridge is required. Any standard case can be loaded quickly and easily.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. An ammunition cartridge having a reduced propellant charge comprising:

a reusable case having a base end and an open end;

a primer inserted in the base end of said case;

means for rigidly positioning, forming, and securing a reduced propellant charge within said case, said means being a foam filler which is gasifiable and expellable from said case during firing of the cartridge said foam filler extending from, said base end toward said forward end, said foam filler having a tapered conical interior volume;

a propellant charge inserted in said means for rigidly positioning, forming and securing;

a projectile having an open interior volume and being inserted into and affixed to the open end of said case and extending forward of said open end; and a tracer material inserted into the open interior volume of said projectile.

2. An ammunition cartridge having a reduced propellant charge as in claim 1 wherein said means for rigidly positioning, forming and securing comprises said foam filler glued in place within the cartridge.

3. An ammunition cartridge having a reduced propellant charge as an claim 2 wherein said foam filler comprises a hollow, substantially cylindrical, insert.

4. An ammunition cartridge having a reduced propellant charge as in claim 1 wherein said foam filler is molded inside said case.

5. An ammunition cartridge having a reduced propellant charge comprising:

a reusable case having a base end and an open end;

a primer inserted in the base end of said case;

a foam filler, said filler being gasifiable and expellable from the case during firing of the cartridge, having an open interior volume, externally molded, inserted and glued into said case said foam filler extending from said base end toward said forward end, said foam filler having a tapered conical interior volume;

a propellant charge inserted in the open interior volume of said foam filler;

a projectile having an open interior volume and being inserted into and affixed to the open end of said case and extending forward of said open end; and a tracer material inserted into the open interior volume of said projectile.

* * * * *